US005806503A

United States Patent [19]

McLeod

[11] Patent Number: 5,806,503

[45] Date of Patent: Sep. 15, 1998

[54] DISCHARGE IGNITION APPARATUS FOR INTERNAL COMBUSTION ENGINE HAVING STEPPED SPARK ADVANCE

[75] Inventor: Paul W. McLeod, Warrenville, S.C.

[73] Assignee: R.E. Phelon Company, Inc., Aiken, S.C.

[21] Appl. No.: 787,786

[22] Filed: Jan. 23, 1997

[51] Int. Cl.[6] ..... F02P 1/00

[52] U.S. Cl. ..... 123/602; 123/149 C

[58] Field of Search ..... 123/602, 149 C, 123/418, 421, 424, 618

[56] References Cited

U.S. PATENT DOCUMENTS

| | | | |
|---|---|---|---|
| Re. 31,837 | 2/1985 | Burson . | |
| 3,515,109 | 6/1970 | Farr | 123/602 |
| 3,646,667 | 3/1972 | Janisch | 123/149 C |
| 3,651,795 | 3/1972 | Nioddin | 123/149 C |
| 3,661,132 | 5/1972 | Farr | 123/149 D |
| 3,722,488 | 3/1973 | Swift et al. . | |
| 3,809,040 | 5/1974 | Burson et al. . | |
| 3,838,671 | 10/1974 | Farr | 123/602 |
| 4,079,712 | 3/1978 | Nogasawa . | |
| 4,538,586 | 9/1985 | Miller . | |
| 4,746,825 | 5/1988 | Phelon . | |
| 5,513,619 | 5/1996 | Chen et al. . | |
| 5,606,958 | 3/1997 | Chrintz-Gath et al. . | |

*Primary Examiner*—Tony M. Argenbright
*Assistant Examiner*—Hieu T. Vo
*Attorney, Agent, or Firm*—Dority & Manning

[57] ABSTRACT

An improved capacitive discharge ignition apparatus provides a step advance in spark initiation at a predetermined threshold speed. The ignition apparatus includes two trigger circuits electrically connected to a triggering node of an electronic switch device. A triggering signal received from either trigger circuit will cause discharge of an energy storage element through the primary coil of the ignition's step-up transformer. The first trigger circuit is configured to supply an advanced triggering signal only at speeds exceeding the predetermined threshold. In addition, to enhance spark duration, the advanced triggering signal is preferably timed to occur when a sustaining potential is being otherwise induced on the secondary coil of the transformer. The second trigger circuit includes a trigger coil spaced apart from the transformer to provide a delayed triggering signal at speeds below the predetermined threshold speed.

24 Claims, 4 Drawing Sheets

DISCHARGE IGNITION APPARATUS FOR INTERNAL COMBUSTION ENGINE HAVING STEPPED SPARK ADVANCE

BACKGROUND OF THE INVENTION

The present invention generally relates to an improved ignition system for use in an internal combustion engine. More particularly, the invention relates to a discharge ignition apparatus that provides automatic spark advance at a predetermined operating speed.

Particularly in the case of four-cycle engines, it is often desirable to advance the ignition spark as engine speed is increased. For example, the spark may be delayed at starting speeds until approximately peak compression of the engine's piston. At higher engine speeds, the spark is preferably advanced to occur before peak compression. In many cases, an advance of twenty (20) degrees or more would not be uncommon.

The present invention is directed to various novel ignition arrangements providing automatic spark advance.

SUMMARY OF THE INVENTION

In one aspect, the present invention provides an ignition apparatus for use with an internal combustion engine to produce an electrical spark at a spark ignition device. The apparatus comprises a magnet assembly including a pair of pole faces operatively revolved along a circular path. A magnetically permeable core having at least two leg portions each including a respective end face is mounted adjacent to the circular path. The leg portions of the magnetically permeable core are situated such that the pole faces pass proximate to the end faces during revolution of the magnet assembly. As a result, a magnetic flux is produced in the magnetically permeable core.

The ignition apparatus further includes a transformer having a primary coil and a secondary coil related by a predetermined step-up ratio. The secondary coil is electrically connected during operation to the spark ignition device. A spark generation circuit is operative to apply a primary voltage pulse to the primary coil responsive to a triggering signal. A spark generating pulse is responsively produced in the secondary coil.

Triggering circuitry is also provided, configured to provide a delayed triggering signal below a predetermined operating speed. The triggering circuitry further provides an advanced triggering signal above the predetermined operating speed.

In some exemplary embodiments, the triggering circuitry comprises a first circuit portion operative to apply the advanced triggering signal to the spark generation circuit above the predetermined operating speed. In this case, the first circuit portion may be configured to supply the advanced triggering signal at a time when the magnetic flux is inducing a spark sustaining potential on the secondary coil.

A second circuit portion including a trigger coil spaced apart from the transformer may also be provided to apply the delayed triggering signal to the spark generation circuit. The trigger coil may be spaced apart from the transformer sufficient to provide an advance of at least approximately nine (9) degrees. For example, the trigger coil may be spaced apart from the transformer sufficient to provide an advance of at least approximately twenty (20) degrees.

In some exemplary embodiments, the spark generation circuit may include an energy storage element, such as a capacitor. A charge coil may also be provided so that voltage induced thereon by the magnetic flux will supply charging energy to the energy storage element during each revolution of the magnet assembly. An electronic switch may be electrically connected in circuit with the energy storage element and the primary coil.

Preferably, the electronic switch is rendered conductive by either the advanced triggering signal or the delayed triggering signal. The electronic switch may comprise a single circuit element, such as a silicon-controlled rectifier (SCR), having a triggering node for this purpose.

The first circuit portion may comprise a voltage divider network electrically connected across the primary coil for producing the advanced triggering signal at a divider node thereof. The voltage divider network may preferably be configured to supply the advanced triggering signal at a time when the magnetic flux is inducing a spark sustaining potential on the secondary coil.

In another aspect, the present invention provides a discharge circuit for use in a discharge ignition system of the type operative to produce an electrical spark at a spark ignition device. The discharge circuit comprises a storage capacitor and a charge coil, as well as a rectifier electrically connected therebetween. A transformer is also provided, including a primary coil and a secondary coil. The secondary coil of the transformer is electrically connected during operation to the spark ignition device to produce the electrical spark.

The discharge circuit further includes a trigger coil for placement in spaced apart relation from the transformer. An electronic switch, rendered conductive by a triggering signal applied to a triggering node thereof, is electrically connected in circuit with the storage capacitor and the primary coil.

A first trigger circuit is electrically connected to the triggering node. The first trigger circuit is operative to apply an advanced triggering signal to the triggering node above a predetermined operating speed. A second trigger circuit, electrically connected between the trigger coil and the triggering node, is operative to apply a delayed triggering signal to the triggering node.

In some exemplary embodiments, the first trigger circuit derives the advanced triggering signal from voltage induced on the primary coil. The first trigger circuit may comprise a voltage divider network electrically connected across the primary coil for producing the advanced triggering signal at a divider node thereof. The voltage divider network may include a thermistor device to compensate for temperature variations that could otherwise affect the operating speed at which spark advance occurs.

In another aspect, the present invention provides a discharge ignition apparatus comprising a movable magnet assembly including a pair of pole faces. A magnetically permeable core having at least two leg portions each including a respective end face is also provided. The magnetically permeable core is mounted such that the pole faces pass proximate to the end faces as the magnet assembly is operatively moved to produce a magnetic flux in the magnetically permeable core. A transformer having a primary coil and a secondary coil is also provided, with the secondary coil being electrically connected during operation to the spark ignition device.

The discharge ignition apparatus further includes a discharge circuit including an energy storage element. A charge coil having a charging voltage induced thereon by the magnetic flux is provided to supply charging energy to the energy storage element. In addition, an electronic switch is electrically connected in circuit with the energy storage element and the primary coil. Activation of the electronic switch during operation produces a voltage on the primary coil.

In addition, the discharge circuit includes a first trigger circuit operative to activate the electronic switch if a speed of the movable magnet assembly exceeds a predetermined threshold speed. The first trigger circuit may be configured to activate the electronic switch at a time when the magnetic flux is inducing a spark sustaining potential on the secondary coil. The first trigger circuit may comprise a voltage divider network electrically connected across the primary coil for producing a triggering signal at a divider node thereof.

The discharge circuit may further include a second trigger circuit operative to activate the electronic switch if a speed of the movable magnet assembly is less than the predetermined threshold speed. In some exemplary embodiments, the second trigger circuit includes a trigger coil spaced apart from the transformer. For example, the trigger coil is spaced apart from the transformer sufficient to provide an advance of at least approximately twenty (20) degrees.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
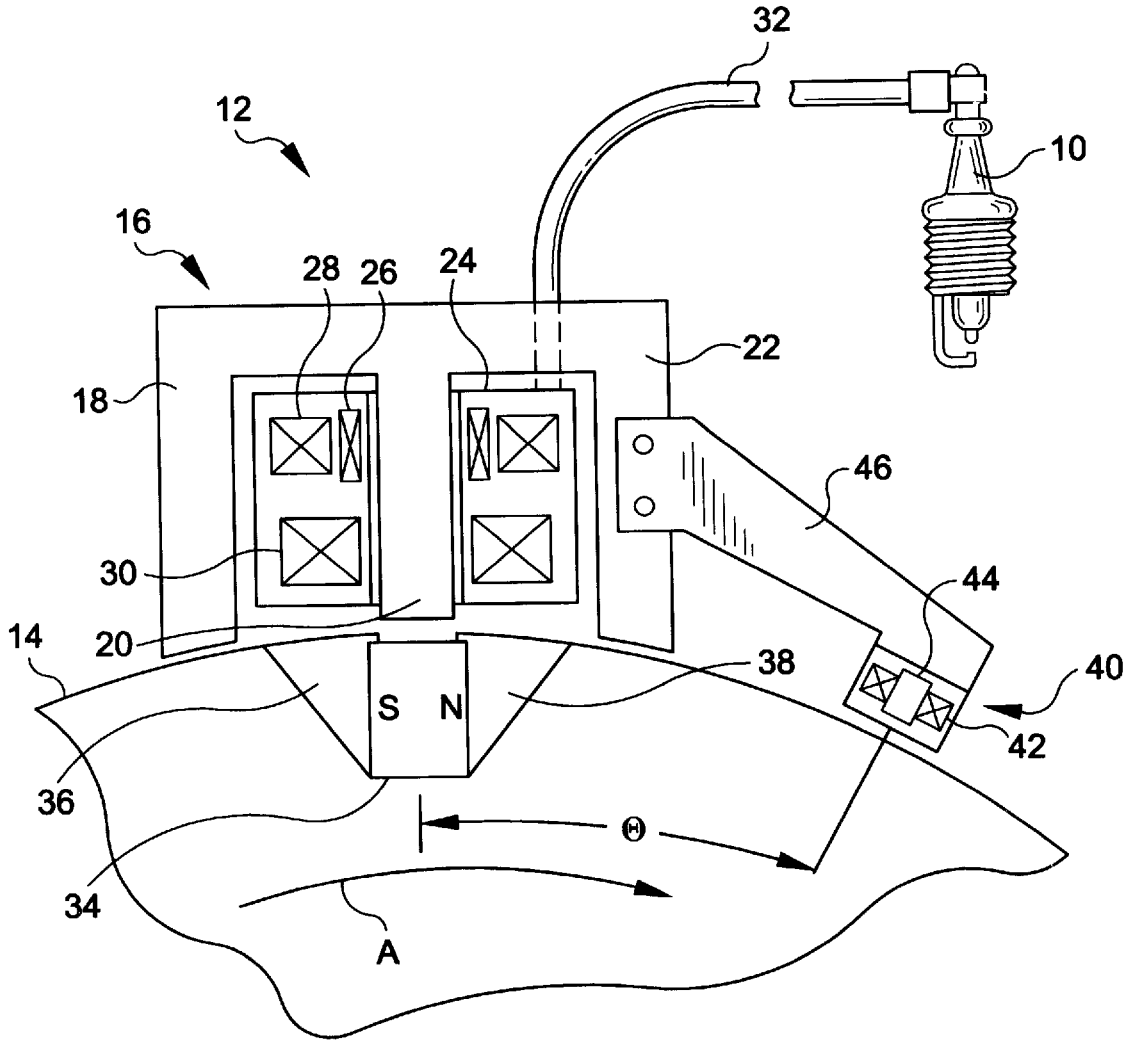
FIG. 1 is an elevational view of various components in a discharge ignition system such as may be constructed according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a discharge ignition apparatus constructed in accordance with the present invention. The apparatus is configured to produce the requisite spark at spark plug 10 to ignite the air-fuel mixture within the piston cylinder of the engine. The apparatus may be used with various devices powered by gasoline engines, particularly four-cycle gasoline engines.

Generally, the apparatus includes a stator unit 12 and a rotatable flywheel 14. Flywheel 14 typically includes a central bore for mounting to a rotatable spindle mechanically interconnected with the engine's drive shaft. As a result, rotation of the spindle will produce a concomitant rotation of flywheel 14 (such as in the direction indicated by arrow A).

Stator unit 12, which typically remains fixed with respect to the engine during use, includes a magnetically permeable core 16. In this case, core 16 includes three depending leg portions, respectively indicated at 18, 20 and 22. In many embodiments, however, the magnetically permeable core may be constructed having only two such leg portions.

A sealed housing 24 maintains the various coils and other components utilized to produce a spark at spark plug 10. In particular, housing 24 includes a transformer having a primary coil 26 and a secondary coil 28. In the illustrated embodiment, coils 26 and 28 may be mounted coaxially about center leg 20. A charge coil 30, which may also be mounted about center leg 20, provides a source of energy for the ignition spark as will be explained more fully below. The various components within housing 24 may be protected and maintained securely in position via a suitable potting compound. Electrical connection with spark plug 10 is achieved by a typical interconnecting wire 32.

A magnet assembly is mounted adjacent the periphery of flywheel 14 to revolve about a circular path in synchronism with operation of the engine. The magnet assembly includes a permanent magnet 34 having pole pieces 36 and 38 mounted at respective ends thereof. It will be appreciated that the circumferential faces of pole pieces 36 and 38 will pass proximate to the end faces of leg portions 18, 20 and 22 as flywheel 14 is rotated. As a result, magnetic flux is produced within core 16, as desired.

The discharge ignition apparatus further includes a trigger unit 40 spaced apart from stator unit 12. Trigger unit 40 includes a trigger coil 42 situated about an auxiliary core 44 of magnetically permeable material. In this case, trigger unit 40 is maintained in position by an arm connected to leg portion 22.

It can be seen that core 44 is mechanically separated from center leg 20 by an angle Θ, which in many cases may be greater than eighteen (18) degrees. For example, this mechanical separation may be approximately thirty (30) degrees in many embodiments of the present invention. The mechanical separation of trigger unit 40 causes a flux to be induced in core 44 at a time later than the flux induced in core 16.

Figure 2:
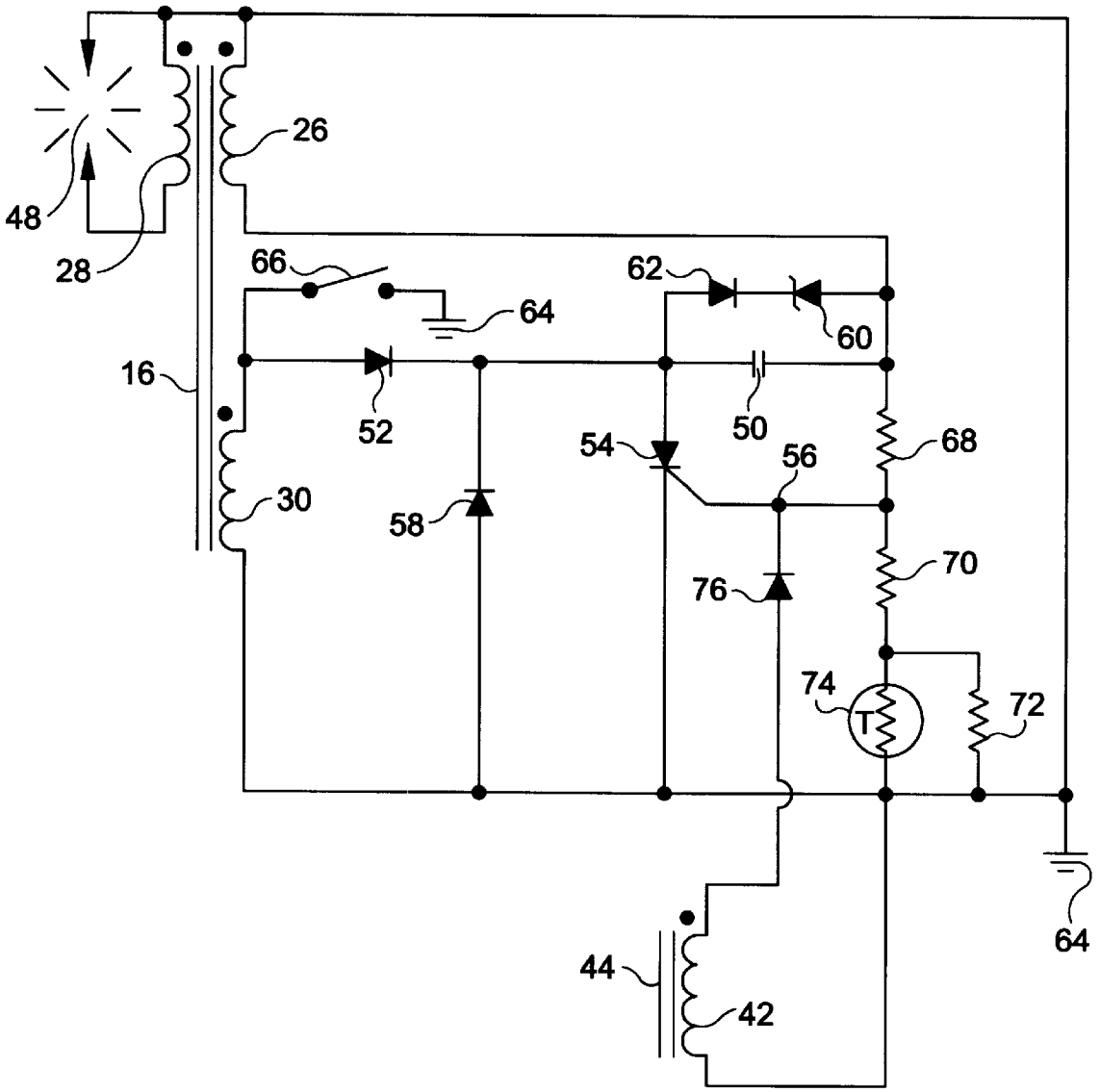
FIG. 2 is a schematic diagram illustrating an exemplary electronic ignition circuit constructed according to the present invention.

The various electronic components contained within sealed housing 24 of stator unit 12 may be most easily understood with reference to the schematic circuit diagram of FIG. 2. As can be seen, secondary coil 28 is connected across the gap 48 of spark plug 10. Charge coil 30 is electrically connected to a storage capacitor 50 through a rectifier diode 52. Capacitor 50 is, in turn, electrically connected in circuit with primary coil 26 through SCR 54. SCR 54 is rendered conductive by a triggering signal supplied to triggering node 56, which is the SCR gate.

Diode 58 functions as a ringback diode for reversal of the polarity of capacitor 50 during discharge. Zener diode 60 is provided to inhibit overvoltage on capacitor 50, whereas diode 62 prevents backfeed from primary coil 26. A floating ground, as indicated at 64, typically provides electrical communication with the engine block. A stop switch 66 may also be provided to disable operation of the ignition system.

The illustrated embodiment of the discharge ignition apparatus includes two trigger circuits, each providing a triggering signal to node 56. The first trigger circuit provides an advanced triggering signal used at operating speeds above a preselected threshold. This triggering signal may be derived from the voltage induced across the primary coil.

For example, triggering node 56 may be connected to primary coil through a current limiting resistor. In many applications, however, it will be desirable to shift the trigger signal to occur at a time when a sustaining potential is being otherwise induced on the secondary coil. As a result, a spark initiated by capacitor discharge can be maintained for a longer duration without the use of a larger discharge capacitor. Spark durations of approximately 500 $\mu$sec or longer may be achieved in this manner.

As described in U.S. Pat. No. 5,513,619 to Chen et al., incorporated herein by reference, this shifted trigger signal may be produced using a voltage divider network. In the illustrated embodiment, the voltage divider network comprises three resistors 68, 70 and 72, as well as thermistor 74, electrically connected across the primary coil. The triggering signal is produced in this case at the junction of resistors 68 and 70. As one skilled in the art will appreciate, thermistor 74 inhibits shift of the trigger point which could otherwise occur with temperature.

The second trigger circuit provides a delayed trigger signal utilized at start-up speeds below the threshold speed. In this case, the second trigger circuit includes trigger coil 42, which is connected to node 56 through diode 76. It can be seen that diode 76 will prevent backfeed of current from the first trigger circuit into trigger coil 42.

The operation of the circuit shown in FIG. 2 will now be explained with reference to the waveforms illustrated in FIGS. 3A through 3C. The illustrated waveforms are merely diagrammatic in nature for which scale is not implied. In addition, one skilled in the art will recognize that references to "positive" or "negative" are merely a matter of convention. It will also be appreciated that the illustrated sequence is repeated for every revolution of the magnet assembly.

Figure 3A:
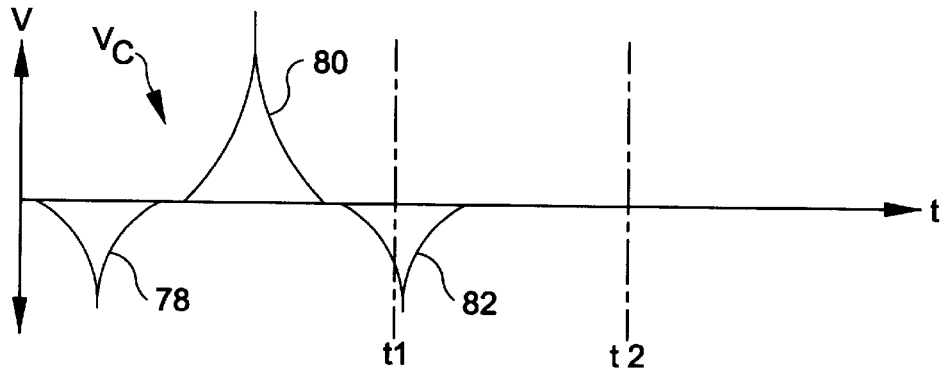
FIGS. 3A through 3C diagrammatically illustrate various voltage plots taken at respective locations in the circuit of FIG. 2.

FIG. 3A illustrates a waveform $V_c$ of the voltage produced across charge coil 30 during one passage of the magnet assembly carried by flywheel 14. As can be seen, waveform $V_c$ includes a first negative excursion 78 followed by a relatively large positive excursion 80. Typically, capacitor 50 will be charged during positive excursion 80, and assume a value near the peak voltage reached during the excursion. A smaller negative excursion 82 follows positive excursion 80.

Figure 3B:
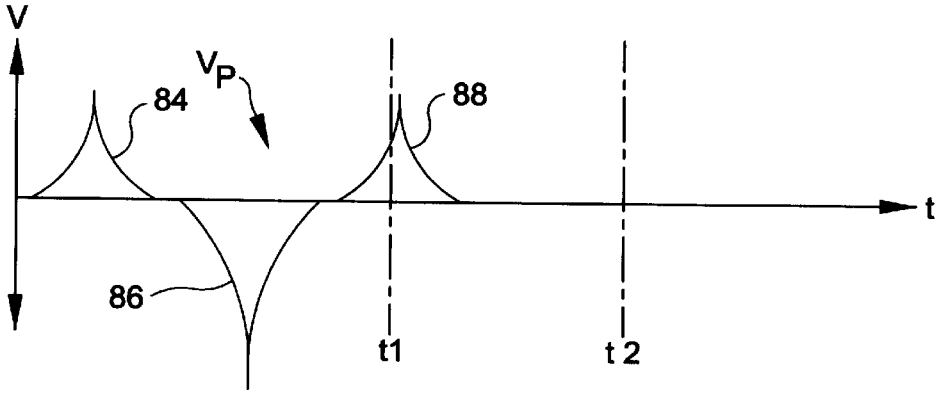

FIG. 3B illustrates a waveform $V_p$ such as may be induced across primary coil 26 at corresponding points in time. The voltage waveform induced across secondary coil 28 will have a similar shape, although the magnitude will be larger due to the greater number of turns at this winding. As can be seen, waveform $V_p$ exhibits a positive excursion 84 followed by a negative excursion 86. Negative excursion 86 is then followed by a positive excursion 88.

While positive excursion 84 applies a triggering signal to the SCR gate, capacitor 50 has not yet been charged. During positive excursion 88, however, capacitor 50 has been charged and is ready to discharge through primary coil 26. If the voltage induced in primary coil 26 is applied directly to the SCR gate, such discharge will occur near the beginning of positive excursion 88.

As stated above, however, it is desirable to shift the triggering signal to a point at which a sustaining potential is being induced in secondary coil 28. This occurs near the peak of positive excursion 88, such as at time $t_1$. This shift may be produced using the voltage divider network illustrated in FIG. 2.

At start-up speeds less than a predetermined threshold, the triggering signal produced by the first trigger circuit will be insufficient to gate SCR 54. As a result, the accumulated voltage can be maintained on capacitor 50 and advantageously discharged later using trigger coil 42. When the threshold speed is reached, the ignition will be automatically advanced by the inherent increase in the voltage induced across the primary coil.

Figure 3C:
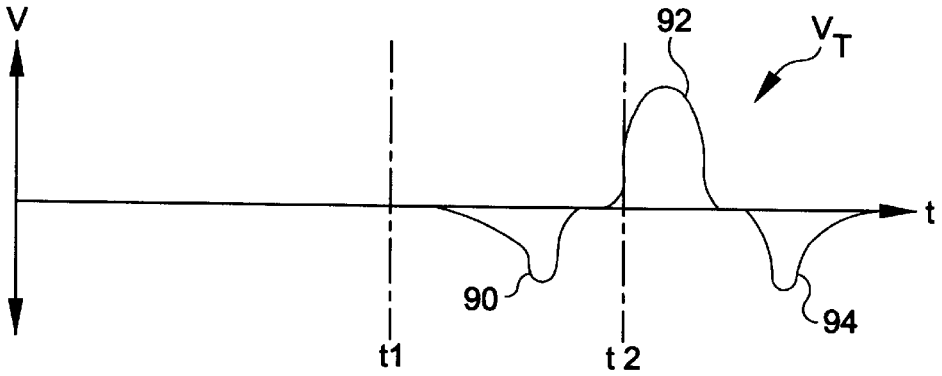

FIG. 3C illustrates waveform $V_T$ such as may be produced across trigger coil 42. As shown, waveform $V_T$ displays a negative excursion 90 followed by a positive excursion 92. Another negative excursion 94 then follows positive excursion 92.

As shown, SCR 54 is gated at a time $t_2$ when a sufficient voltage is induced across trigger coil 42. At start-up speeds less than the predetermined threshold, trigger coil 42 will cause a delayed discharge of capacitor 50 at this time. As can be seen, the period of such delay is the time $t_2$ minus $t_1$. This delay period can be thought of as an advance angle $K\Theta$ proportional to the mechanical spacing $\Theta$ between the transformer and trigger coil 42. Preferably, the advance angle $K\Theta$ may be at least approximately nine (9) degrees (for $\Theta$ of at least eighteen (18) degrees). In a presently preferred embodiment, the advance angle may be at least approximately twenty (20) degrees (for $\Theta$ of at least thirty (30) degrees).

Figure 4:
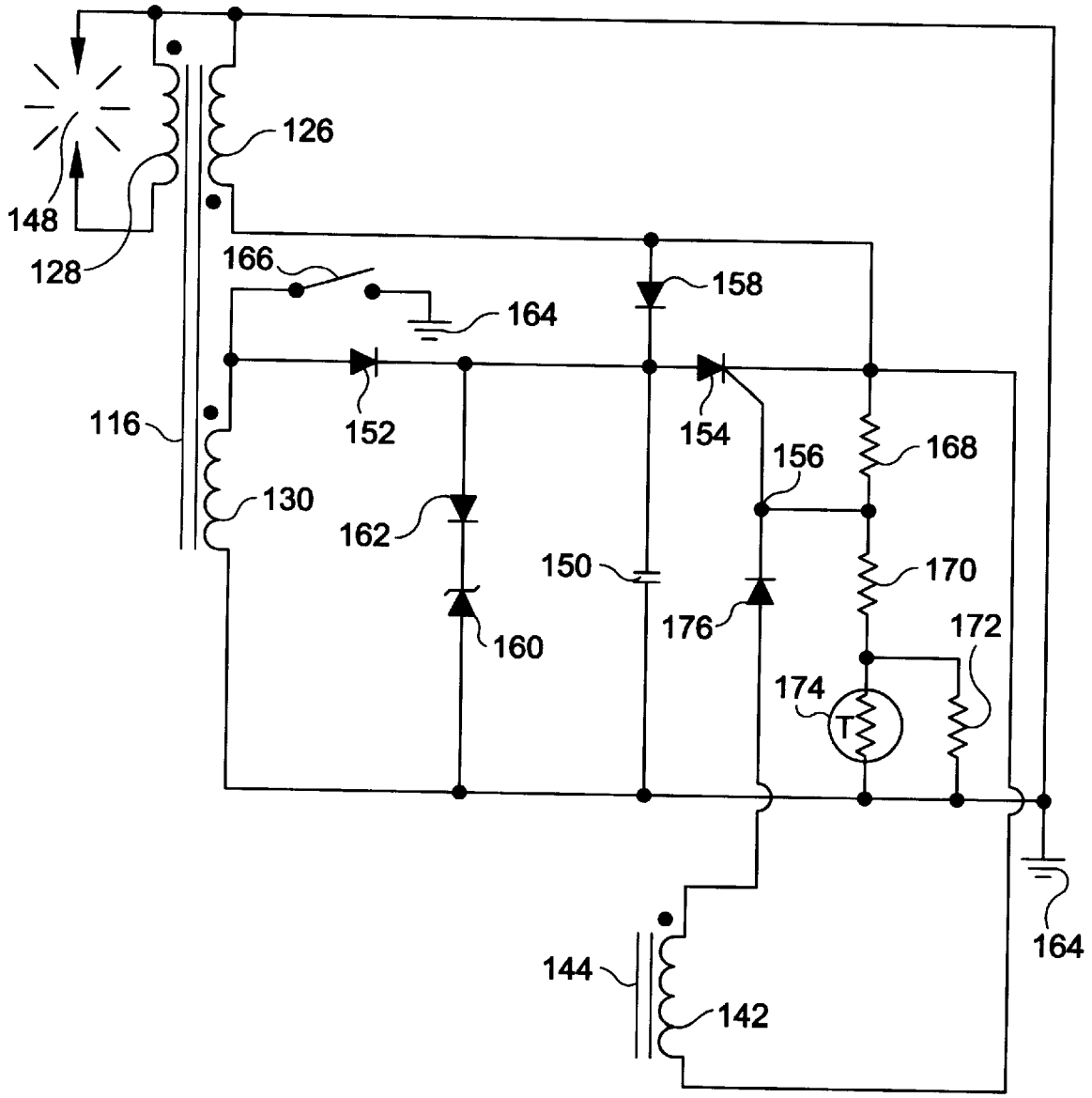
FIG. 4 is a schematic diagram illustrating an alternative electronic ignition circuit constructed according to the present invention.

FIG. 4 illustrates an alternative circuit arrangement that operates in a manner similar to the circuit of FIG. 2 in many important respects. As such, analogous components in the FIG. 4 circuit have reference numbers augmented by one-hundred in comparison with their counterparts in FIG. 2. One skilled in the art will understand operation of the FIG. 4 circuit without a detailed discussion.

It can be seen, however, that the relative positions of capacitor 150 and SCR 154 have been reversed in relation to their counterparts in the circuit of FIG. 2. This results in the positions of diodes 158, 160 and 162 being also reversed in relation to their counterparts, as shown.

While preferred embodiments of the invention have been shown and described, modifications and variations be made thereto by those of ordinary skill in the art without departing from the spirit and scope of the present invention. For example, it may be desirable in some circuit arrangements to substitute an inductor or other circuit component as the energy storage element. In addition, it should be understood that aspects of various embodiments of the invention may be interchanged both in whole or in part. Furthermore, those of ordinary skill in the art will appreciate that the foregoing description is by way of example only, and is not intended to be limitative of the invention so further described in the appended claims.

What is claimed is:

1. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal, said primary voltage pulse producing a spark generating pulse in said secondary coil; and triggering circuitry configured to provide a delayed triggering signal below a predetermined operating speed and an advanced triggering signal above said predetermined operating speed, said triggering circuitry being configured such that said delayed triggering signal is provided by a separate trigger coil angularly spaced apart from said transformer and said advanced triggering signal is derived from a voltage induced across said primary coil.

2. An ignition apparatus as set forth in claim 1, wherein said triggering circuitry is configured to supply said advanced triggering signal at a time when said magnetic flux is inducing a spark sustaining potential on said secondary coil.

3. An ignition apparatus as set forth in claim 1, wherein said trigger coil is spaced apart from said transformer sufficient to produce an advance of at least approximately nine (9) degrees.

4. An ignition apparatus as set forth in claim 3, wherein said trigger coil is spaced apart from said transformer sufficient to produce an advance of at least approximately twenty (20) degrees.

5. An ignition apparatus as set forth in claim 1, wherein said spark generation circuit comprises:

(a) an energy storage element;

(b) a charge coil having a voltage induced thereon by said magnetic flux to supply charging energy to said energy storage element during each revolution of said magnet assembly; and (c) an electronic switch electrically connected in circuit with said energy storage element and said primary coil, said electronic switch being rendered conductive by one of said advanced triggering signal and said delayed triggering signal.

6. An ignition apparatus as set forth in claim 5, wherein said electronic switch comprises a single circuit element, said first circuit portion and said second circuit portion each being electrically connected to a triggering node thereof.

7. An ignition apparatus as set forth in claim 6, wherein said first circuit portion comprises a voltage divider network electrically connected across said primary coil for producing said advanced triggering signal at a divider node thereof.

8. An ignition apparatus as set forth in claim 7, wherein said voltage divider network is configured to supply said advanced triggering signal at a time when said magnetic flux is inducing a spark sustaining potential on said secondary coil.

9. An ignition apparatus as set forth in claim 5, wherein said energy storage element is a capacitative storage element.

10. An ignition apparatus as set forth in claim 1, wherein said magnet assembly is carried by a rotatable engine flywheel.

11. A discharge circuit for use in a discharge ignition system of the type operative to produce an electrical spark at a spark ignition device, said discharge circuit comprising:

(a) a storage capacitor;

(b) a charge coil;

(c) a rectifier electrically connected between said charge coil and said storage capacitor;

(d) a transformer including a primary coil and a secondary coil, said secondary coil electrically connected during operation to the spark ignition device to produce the electrical spark;

(e) a trigger coil for placement in spaced apart relation from said transformer;

(f) an electronic switch electrically connected in circuit with said storage capacitor and said primary coil, said electronic switch being rendered conductive by a triggering signal applied to a triggering node thereof;

(g) a first trigger circuit electrically connected to said triggering node, said first trigger circuit operative to apply an advanced triggering signal to said triggering node above a predetermined operating speed, said first trigger circuit being electrically connected between said primary coil and said triggering node; and (h) a second trigger circuit electrically connected between said trigger coil and said triggering node, said second trigger circuit operative to apply a delayed triggering signal to said triggering node.

12. A discharge circuit as set forth in claim 11, wherein said first trigger circuit comprises a voltage divider network electrically connected across said primary coil for producing said advanced triggering signal at a divider node thereof.

13. A discharge circuit as set forth in claim 12, wherein said voltage divider network includes a thermistor device.

14. A discharge circuit as set forth in claim 11, wherein said electronic switch is a silicon-controlled rectifier (SCR).

15. A discharge circuit as set forth in claim 11, further comprising a ringback diode electrically connected between said storage capacitor and relative ground.

16. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved to produce a magnetic flux in said magnetically permeable core;

a transformer having a primary coil and a secondary coil, said secondary coil electrically connected during operation to the spark ignition device; and a discharge circuit including:

(a) an energy storage element;

(b) a charge coil having a charging voltage induced thereon by said magnetic flux to supply charging energy to said energy storage element;

(c) an electronic switch electrically connected in circuit with said energy storage element and said primary coil, activation of said electronic switch during operation producing a voltage on said primary coil;

(d) a first trigger circuit operative to activate said electronic switch if a speed of said movable magnet assembly exceeds a predetermined threshold speed, said first trigger circuit being electrically connected to activate said electronic switch based on voltage induced across said primary coil; and (e) a second trigger circuit operative to activate said electronic switch if a speed of said movable magnet assembly is less than said predetermined threshold speed, said second trigger circuit including a trigger coil angularly spaced apart from said transformer.

17. A discharge ignition apparatus as set forth in claim 11, wherein said trigger coil is spaced apart from said transformer sufficient to produce an advance of at least approximately nine (9) degrees.

18. A discharge ignition apparatus as set forth in claim 16, wherein said first trigger circuit is configured to activate said electronic switch at a time when said magnetic flux is inducing a spark sustaining potential on said secondary coil.

19. A discharge ignition apparatus as set forth in claim 16, wherein said electronic switch comprises a single circuit element, said first trigger circuit and said second trigger circuit each being electrically connected to a triggering node thereof.

20. A discharge ignition apparatus as set forth in claim 19, wherein said electronic switch is a silicon-controlled rectifier (SCR) electrically connected between said energy storage element and said relative ground.

21. A discharge ignition apparatus as set forth in claim 19, wherein said first trigger circuit comprises a voltage divider network electrically connected across said primary coil for producing a triggering signal at a divider node thereof.

22. A discharge ignition apparatus as set forth in claim 21, wherein said voltage divider network is configured to supply said triggering signal at a time when said magnetic flux is inducing a spark sustaining potential on said secondary coil.

23. A discharge ignition apparatus as set forth in claim 16, wherein said energy storage element is a capacitative storage element.

24. A discharge ignition apparatus as set forth in claim 16, wherein said magnet assembly is carried by a rotatable engine flywheel.

* * * * *